US005499089A

United States Patent [19]

Tsukamoto et al.

[11] Patent Number: 5,499,089

[45] Date of Patent: Mar. 12, 1996

[54] TONER IMAGE FIXING DEVICE WITH DEFORMABLE CYLINDER

[75] Inventors: Kimihide Tsukamoto, Yamatokooriyama; Masaru Tsuji, Nara, both of Japan

[73] Assignee: Sharp Kabushiki Kaisha, Osaka, Japan

[21] Appl. No.: 314,245

[22] Filed: Sep. 28, 1994

[30] Foreign Application Priority Data

Nov. 19, 1993 [JP] Japan ..... 5-290272

[51] Int. Cl.[6] ..... G03G 15/20

[52] U.S. Cl. ..... 355/290; 219/216

[58] Field of Search ..... 355/290, 285; 219/216; 432/59, 60

[56] References Cited

U.S. PATENT DOCUMENTS

| | | | |
|---|---|---|---|
| 3,452,181 | 6/1969 | Stryjewski | 355/285 X |
| 4,567,349 | 1/1986 | Henry et al. | 355/290 X |
| 4,763,158 | 8/1988 | Schlueter, Jr. | 219/216 X |
| 5,099,289 | 3/1992 | Kurotori et al. | 355/290 X |

FOREIGN PATENT DOCUMENTS

| | | |
|---|---|---|
| 59-068766 | 4/1984 | Japan . |
| 61-90180 | 5/1986 | Japan . |
| 63-313182 | 12/1988 | Japan . |
| 4-044074 | 2/1992 | Japan . |

*Primary Examiner*—Joan H. Pendegrass
*Assistant Examiner*—Sophia S. Chen
*Attorney, Agent, or Firm*—David G. Conlin; Milton Oliver

[57] ABSTRACT

The present invention is intended to save warm-up time of a toner image fixing device for fixing a toner image by heating and reduce manufacturing cost of the device. Elastically-deformable heat-resistant belt is made in form of a cylinder of nickel which accommodates therein a heater lamp and a reflecting plate for concentrically transferring radiant heat from the heater lamp onto a contacting portion of the cylinder-like belt with a recording paper carrying a toner image. When the recording paper is transported along a guiding plate , the driving roller rotates the heat-resistant belt in contact with the recording paper. At this time, the rotating belt and the guide plate are pressed against each other, thereby the belt is elastically deformed in radial direction. The recording paper is transported being pressed by the belt and, thereby, the toner image is fixed onto the recording paper by heat.

8 Claims, 4 Drawing Sheets

TONER IMAGE FIXING DEVICE WITH DEFORMABLE CYLINDER

BACKGROUND OF THE INVENTION

The present invention relates to a toner image fixing device which has a novel construction for thermally fixing a toner image developed on a sheet-like carrier, e.g., a recording paper.

In a conventional image-recording device, a recording medium forms thereon a toner image and transfers it onto a common paper sheet which is subjected to fixing the toner image thereon and then is delivered out of the device. Generally, the toner image is fixed on a paper sheet by fusing.

A fixing device used in the image recording device comprises a rotatably mounted heating roller made of aluminum drum coated with fluorocarbon resin (e.g., PTFE: polytetrafluoroethylene sold under the trade name "Teflon") which is free from adhesion of toner, a pressure roller coated with silicone rubber disposed as pressed against the heating roller to form therebetween a contact portion (nip) utilizing elastic deformation of the pressure roller. While a sheet carrying a toner image developed with toner thereon passes through the printing nip, the toner image is heated and fixed by fusing to the sheet. A heater consisting of, e.g., a halogen lamp is mounted in the heating roller to heat the latter at a specified temperature necessary for fusing toner of the toner image on the sheet.

In the above-mentioned fixing device, the heating roller is made of an aluminum drum having wall thickness of 1.0 mm to several millimeters and outer diameter of 20 to 60 mm. A toner image developed with toner on the paper sheet is fixed by fusing while the sheet passes through a nip (contacting portion) between the pressure roller and the heating roller heated at a specified temperature by the heater axially mounted therein.

Another example of a toner image fixing device that is different from the above-mentioned device is proposed, wherein a belt being an endless film of 10 to 50 microns in thickness made of heat-resistant material (e.g., polyamide) envelops therein a heater supporting member which supports a heater having a resistance on a ceramic substrate in such a manner that the heater may be in contact with an internal surface of the endless belt. A pressure roller is disposed opposite to the heater and pressed against an external surface of the endless belt to form a nip portion through which a paper sheet having a developed toner image passes being subjected to fixture of the toner image thereon by fusing.

As described previously, the conventional toner image fixing device uses the heating roller having a thick wall of 1.0 to several millimeters in radial direction, which, therefore, shall be previously heated by conduction heat to a specified working temperature of its surface for a warm-up time of several seconds to several minutes. The long warm-up time of the heating roller degrades the controllability of the device as well as increases the power consumption. To put a paper sheet into contact with the heating roller, it is necessary to use the pressure roller having a metal core covered with silicone rubber, which is expensive in itself and increases a manufacturing cost of the conventional device.

In comparison with the above-mentioned device, the other conventional device uses a thin-film type belt to be heated and, therefore, can save its warm-up time and reduce power consumption required. However, this device also has to use the pressure roller for putting the toner-image carrying paper sheet into close contact with the rotating endless belt, that irrevocably leads to increasing the manufacturing cost of the device. The device must be provided with means for driving the endless belt, (e.g., a driving roller and a driven roller), that may not only complicate the construction of the device but also increase its manufacturing cost.

SUMMARY OF THE INVENTION

A primary object of the present invention is to provide a toner image fixing device which may require reduced power consumption and warm-up time, and yet may be manufactured at low cost.

Another object of the present invention is to provide a toner image fixing device which uses not a roller but an elastically deformable cylinder body having a very thin wall for contacting with a toner image on a sheet, thereby reducing the warm-up time necessary to heat the cylinder wall by a heater to a specified temperature.

Another object of the present invention is to provide a toner image fixing device for fixing a toner image developed on a sheet of recording paper by heating, which comprises: a rotatable cylinder body made of heat-resistant and heat-conducting material, which has a wall being elastically deformable in radial direction to obtain a nip width necessary for fixing the toner image on the recording paper; a heater disposed in the cylinder body; and a paper guiding member abutting on the cylinder body to elastically deform the cylinder body in radial direction to form a nip portion of a necessary width therebetween and to support a reverse side of the recording paper carrying the toner image on its top side.

Another object of the present invention is to provide a toner image fixing device for fixing a toner image developed on a sheet of recording paper by heating, which comprises: a rotatable cylinder body made of heat-resistant and heat-conducting material, which has a, wall being elastically deformable in radial direction to obtain a nipping width necessary for fixing the toner image on the recording paper; a heater disposed in the cylinder body; a reflector plate abutting on an inner cylindrical surface of the cylinder body to reflect radiation heat from the heater; a paper guiding member abutting on the cylinder body to elastically deform the cylinder body in radial direction to form a nip portion of a necessary width therebetween and to support a reverse side of the recording paper carrying the toner image on its top side; a driving roller for rotating the cylinder body being sandwiched between the driving roller and the reflector plate; and a cylinder guiding member disposed between the driving roller and the paper guiding member around the cylinder body to regulate rotation of the cylinder body.

The cylinder body is directly and concentrically heated at its portion currently necessary for fixing the toner image on the sheet, that may increase heat efficiency and reduce power consumption of the device.

DESCRIPTION OF THE PREFERRED EMBODIMENTS

Figure 1:
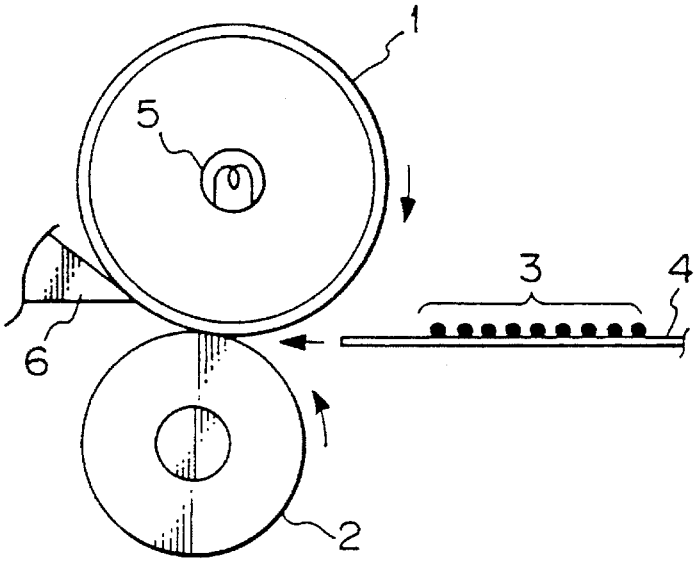
FIG.1 ( PRIOR ART )
FIG. 1 is a sectional view of an example of a conventional toner image fixing device.

FIG. 1 illustrates an example of a conventional toner image fixing device, wherein a rotatably mounted heating roller 1 made of aluminum drum coated with fluorocarbon resin (e.g., PTFE: polytetrafluoroethylene sold under the trade name "Teflon"), which is well-releasable from toner, and a pressure roller 2 coated with silicone rubber are disposed as pressed to each other to form therebetween a contact portion (nip) utilizing elastic deformation of the pressure roller 2. While a sheet 4 carrying a toner image developed with toner 3 thereon passes through the nip, the toner image is heated and fixed by fusing to the sheet 4. A heater 5 consisting of, e.g., a halogen lamp is mounted in the heating roller 1 to heat the latter at a specified temperature necessary for fusing toner 3 on the sheet 4. In FIG. 1, numeral 6 designates a separating finger pressed at its head against the external cylindrical surface of the heating roller 1 to separate the copying sheet 4 from the heating roller.

In the above-mentioned fixing device, the heating roller 1 is made of an aluminum drum having wall thickness of 1.0 mm to several millimeters and outer diameter of 20 to 60 mm. A toner image developed with toner on the sheet 4 is fixed by fusing while the sheet passes through a nip (contacting portion) between the pressure roller 2 and the heating roller 1 heated at a specified temperature by the heater 5 axially mounted therein.

Figure 2:
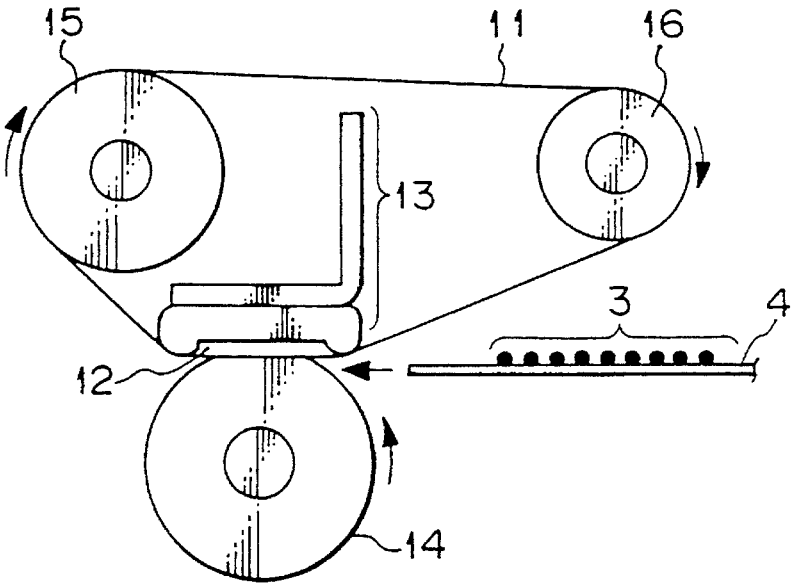
FIG.2 ( PRIOR ART )
FIG. 2 is a sectional view of another example of a conventional toner image fixing device.

Another example of a toner image fixing device that is different from the above-mentioned device is proposed in Japanese laid-open patent publications Nos. 59-68766 and 63-313182, which is shown in FIG. 2. A belt 11 being an endless film of 10 to 50 microns in thickness made of heat-resistant material (e.g., polyamide) envelops therein a heater supporting member 13 which supports a heater 12 having a resistance on a ceramic substrate in such a manner that the heater 12 may be in contact with an internal surface of the endless belt 11. A pressure roller 14 is disposed in opposite to the heater 12 through the endless belt 11 is pressed against an external surface of the endless belt 11 to form a nip portion through which a paper sheet having a developed toner image passes being subjected to fixing the toner image thereon by fusing.

As described previously, the conventional toner image fixing device shown in FIG. 1 uses the heating roller 1 having a thick wall of 1.0 to several millimeters in radial direction, which, therefore, shall be previously heated by conduction heat to a specified working temperature of its surface for a warm-up time of several seconds to several minutes. The long warm-up time of the heating roller degrades the controllability of the device as well as increases the power consumption. To put a paper sheet 4 into contact with the heating roller 1, it is needed to use the pressure roller 2 having a metal core coated with silicone rubber, which is expensive in itself and increases a manufacturing cost of the conventional device.

In comparison with the above-mentioned device, the other conventional device shown in FIG. 2 uses a thin-film type belt 11 to be heated and, therefore, can save its warm-up time and reduce power consumption required. However, this device also has to use the pressure roller for putting the toner-image carrying paper sheet 4 into close contact with the rotating endless belt 11, which irrevocably leads to increasing the manufacturing cost of the device. The device must be provided with means for driving the endless belt 11, (e.g., a driving roller 15 and a driven roller 16), which may not only complicate the construction of the device but also increase its manufacturing cost.

Accordingly, it is an object of the present invention to provide a toner image fixing device which may require reduced power consumption and warm-up time, and yet may be manufactured at relatively low cost.

The present invention provides a toner image fixing device for fixing a toner image developed on a sheet of recording paper by heating. The device has a rotatable cylinder body made of heat-resistant and heat-conducting material, which has a wall being elastically deformable in radial direction to obtain a nip width necessary for fixing the toner image on the recording paper, a heater disposed in the cylinder body; and a paper guiding member abutting on the cylinder body to elastically deform the cylinder body in radial direction to form a nip portion of a necessary width therebetween and to support a reverse side of the recording paper carrying the toner image developed on its top side.

In a toner image fixing device of the present invention, a sheet of recording paper carrying thereon a toner image to be fixed is guided by the paper guiding member to a contacting portion (nip) between the paper guiding member and the cylinder body. In this case, the rotating cylinder body is elastically deformable in radial direction at its portion currently contacting with the paper guiding member. Therefore, the cylinder body may transport the recording sheet through the nip portion formed thereat, simultaneously giving heat to the sheet through its contacting surface heated by the heater. Toner of the toner image is fused by heat and fixed on the recording sheet. The cylinder body is made of heat-conductive material and has a thin wall enough to be elastically deformed. Therefore, it may have high heat-conductivity allowing itself to be heated by the heater to a specified surface temperature for a short time.

The device may use a low-cost flat-type paper guiding member, that may reduce the manufacturing cost of the device. Furthermore, using the elastically deformable cylinder body eliminates the necessity of using an expensive elastically-deformable pressure roller which is used as the guiding member in the conventional device. In the other words, the device according to the present invention can use a simple and inexpensive rotatable roller as a paper guiding member.

A toner image fixing device has a reflector in addition to the structure of the device defined above, which may effectively perform heating the cylinder body. Namely, this reflector plate may concentrically reflect radiation heat from the heater to the contact (nip) portion of the rotating cylinder body with the paper guiding member to effectively heat a sheet of recording paper carrying a toner-image when passing the nip portion between the cylinder body and the paper guiding member. The cylinder body is rotated by the driving roller as it being in contact with the reflector plate internally and with the driving roller externally. A cylinder guiding member is also provided to regulate rotation of the cylinder body. Thus simplified arrangement is effective to stabilize the rotational motion of the cylinder body.

The cylinder guiding member may be provided with a sensor for sensing a surface temperature of the cylinder body to control the cylinder surface temperature at a specified value before the cylinder contacts with the recording paper. This assures durably fixing the toner image thereon. No special means for supporting the sensor is required.

The cylinder guiding portion may also mount thereon a cleaning blade for removing adhering dirt from the outer cylindrical surface of the cylinder body before contacting the cylinder surface with the recording paper. Cleaning the cylinder surface may be also performed by the driving roller. In this case, using the driving roller covered with silicone rubber impregnated with silicone oil may simultaneously achieve cleaning the cylinder surface and applying silicone oil thereto to prevent adhesion of toner to the cylinder surface.

Figure 3:
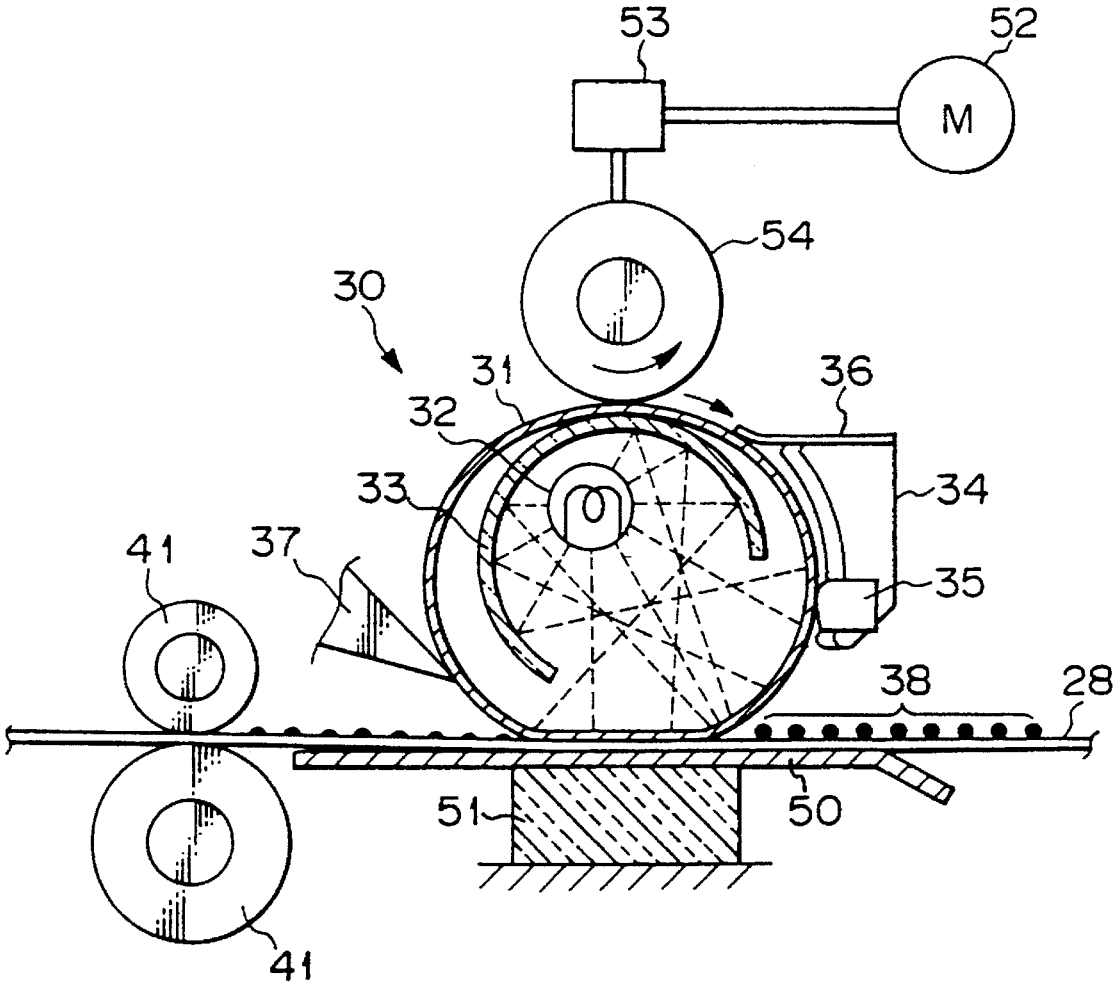
FIG. 3 is a sectional view of an example of a toner image fixing device embodying the present invention.
Figure 4:
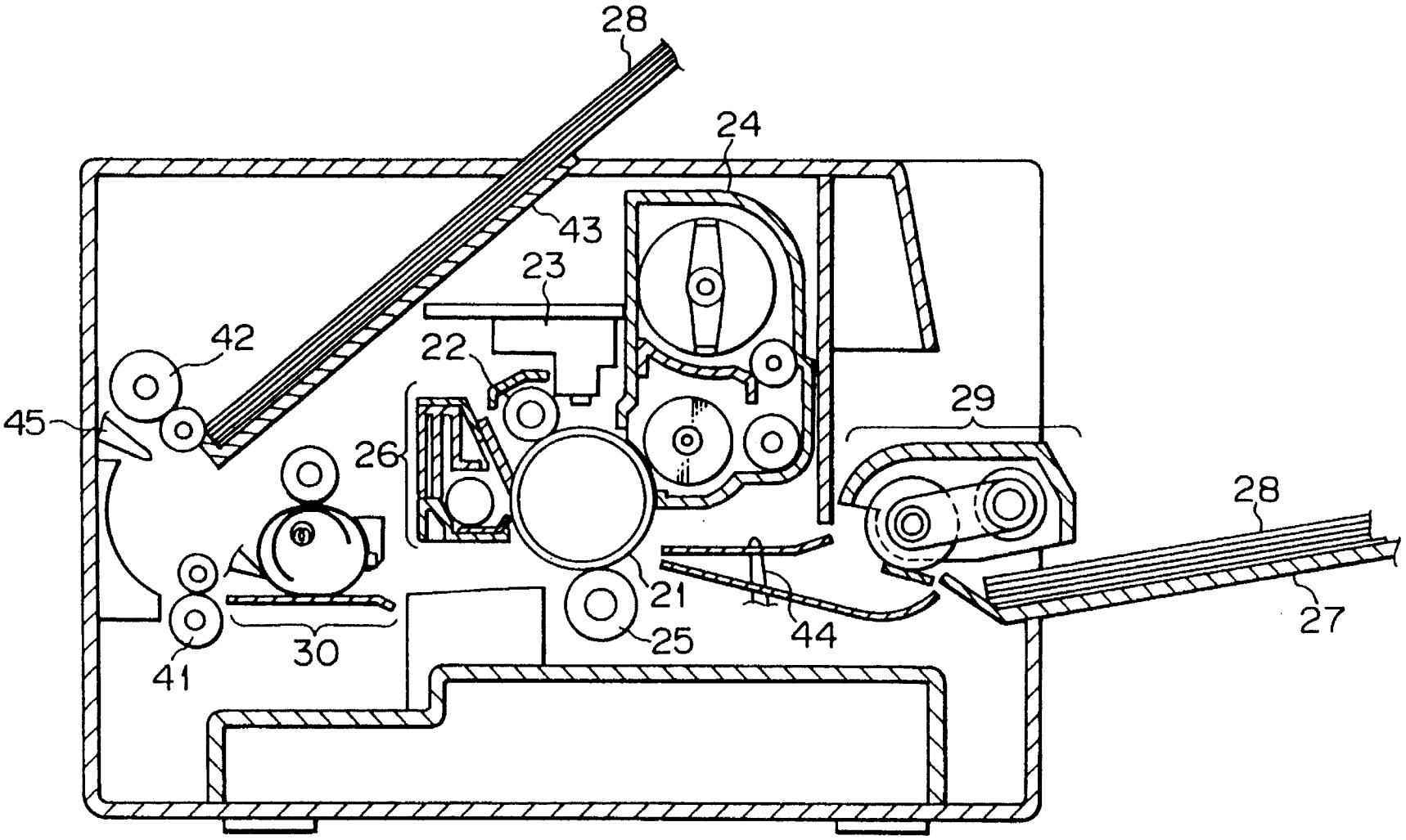
FIG. 4 is a diagrammatic sectional view showing a general construction of a light printer in which a toner image fixing device according to the present invention is used.

Referring now to the accompanying drawings, preferred embodiments of the present invention will be described in detail as follows:

FIG. 3 is a sectional view of a toner image fixing device embodying the present invention. FIG. 4 is a diagrammatic sectional construction view of a light printer which represents an image forming device using a toner image fixing device according to the present invention.

Referring to FIG. 4, there is shown a light printer which includes a light-sensitive body 21 being a cylindrically formed recording medium, an electrically charging device (contact charging roller) 22 for laying-down a charge of specified polarity on the light-sensitive surface, a light-emitting portion 23 for driving a laser or a light-emitting diode according to image-forming information, a developing device 24 for applying toner for developing an electrostatic latent image formed by light irradiation on the light-sensitive medium, an image transferring device (transfer roller) 25 for transferring the toner image from the light-sensitive body to a sheet of recording paper and a cleaner 26 for removing remaining toner particles from the surface of the light-sensitive body prior to building up a following latent image.

A top sheet of common recording sheets 28 piled on a sheet-feeding tray 27 is fed by sheet feeding means to the image transfer roller 25 by which the sheet 28 is guided into a path between the surface of the rotating light-sensitive body 21 and the image transfer roller 25. An image developed with toner on the surface of the rotating light-sensitive body 21 is transferred by the image transfer roller 25 onto the sheet 28 when the latter passing through the path therebetween. The sheet 28 carrying the transferred thereon toner image is separated from the light-sensitive body 21 and fed to a toner image fixing device 30 for fusing toner of the image onto the sheet 28 by heat, whose construction is shown in detail in FIG. 3. The toner image is fixed on the sheet 28 while the latter passes through the fixing device 30. The sheet 28 is transported by delivery rollers 41 and 42 to a delivery tray 43.

In FIG. 4, numerals 44 and 45 designate sheet detectors (microswitches) for detecting a sheet at the inlet and the outlet, respectively, of the printer. When detector 44 detects a recording paper sheet 28 at the inlet of printer, it operates to stop the operation of the sheet feeding means 29, stopping the sheet at the inlet. The detector 44 then operates to start again the feeding operation of the sheet feeding means 29 in synchronism with rotation of the light-sensitive body 21 so that the front edge of the sheet 28 may meet with the front edge of a specified toner-image forming area on the surface of the light-sensitive body 21. The sheet detector 45 detects the printed sheet 28 reached at the outlet of the printer and simultaneously generates a delivered sheet detection signal that is used for counting printed sheets by a sheet counter and for instructing the sheet feeding means 29 to start feeding a next sheet.

Referring now to FIG. 3, there is shown a toner image fixing device according to the present invention, which is composed of a cylinder-like-formed heat-resistant belt 31, a heater-lamp 32 disposed inside the space of the belt to be heated, a reflecting plate 33 for reflect radiant heat from the heater-lamp 32 and a paper guide plate 50 for leading a sheet to be printed 28 to pass around the heat-resisting belt 31 toward a delivery rollers 41.

The heat-resistant belt 31 is, for example, a flexible nickel-made belt which is produced by electro-casting method in the form of an elastically deformable endless belt of about 300 microns in thickness and of about 80 mm in circumferential length. The heat-resistant nickel-made belt 31 also has an excellent heat-conductivity. This cylinder-like-formed heat-resistant belt 31 accommodates therein the heater-lamp 32 for heating the belt, which may be, for example, a halogen lamp of 200 W. The reflecting plate 33 is disposed between the heat-resistant belt 31 and the halogen lamp 32 to effectively heat the belt by concentrically reflecting radiant heat to an area wherein the belt 31 contacts with the recording paper sheet 28 guided by the paper guide plate 50. The reflecting plate 33 may be, for example, an incurred aluminum plate of high reflecting power, which is disposed so that it may bring the radiant heat from the halogen lamp 32 to the area wherein the belt 31 contacts with the recording paper sheet 28.

The heat-resistant belt 31 is driven into rotation by the driving roller 54 pressed against the belt 31 which is sandwiched between the driving roller 54 and the curved rear-surface of the reflecting plate 33. The belt guide 34 having a guiding surface incurved in accordance with the surface of the cylindrical surface of the belt 31 to stabilize the rotational movement of the belt 31 by preventing its lateral shift. This belt guide 34 has a temperature sensor 35 secured thereto for detecting surface temperature of the belt 31. The surface temperature of the heat-resistant belt 31 can be maintained at a constant specified value by regulating a power supply (not shown) of the halogen lamp 32 according to a temperature detection signal generated from the temperature sensor 35.

The driving roller 54 is driven by driving motor 52 through transmission means (e.g., gear transmission) 53 and drives the heat-resistant belt 31. The driving roller 54 may be, for example, a heat-resistant silicone-rubber roller which is rotatably supported, pressing the belt 31 against the rear surface (opposite to the reflecting surface) of the reflecting plate 33. Accordingly, to drive the heat-resistant belt 31 in rotation by the driving roller 54, it is needed to get a friction resistance of the rear surface of the reflecting plate 33 against the heat-resistant belt 31 smaller than that of the driving roller 54 against the heat-resistant belt 31. In this condition, the heat-resistant belt 31 can be rotated slipping on the rear surface of the reflecting plate 33 as the driving roller 54 rotates. The reflecting plate 33 having a small frictional contact with the heat-resistant belt 31 is selected. Coating the rear surface of the reflecting plate 33 with fluorocarbon resin is effective to reduce the friction force.

The operation of the above-mentioned toner-image fixing device 30 will be explained as follows:

A recording-paper sheet 28 whereon a toner image 38 was developed in the preceding process in the printer is separated from the rotating light-sensitive body 21 and advanced by the: rotational movement of the light-sensitive body 21 and the transfer roller 25 along the paper guide plate 50 to the portion contacting with the heat-resistant belt 31 of the toner-image fixing device 30. The driving roller 54 is driven from the driving motor 52 and drives by frictional contact the heat-resistant belt 31 into rotation in the direction shown by arrow in FIG. 3. In this case, the heat-resistant belt 31 is forced to move rightwards but is restricted the belt guide 34 allowing the belt to rotate keeping its constant position.

The sheet 28 moves along the paper guide 50 and enters into contact with the heat-resistant belt 31, then it advanced along the paper guide 50 under the pressure of the heat-resistant belt being deformed in its radial direction. At the same time, as the heat-resistant belt 31 is heated at a specified temperature by a combination of the heater-lamp 32 and the reflecting plate 33 according to a temperature detection signal of the sensor 35, the toner image is fused by heat and fixed on the sheet 28. The sheet 28 is further sent along the paper guide 50 by rotation of the heat-resistant belt 31, then it is separated from the heat-resistant belt 31 and delivered by the transporting rollers 41.

The heat-resistant belt 31 which, as described above, is made of heat-conducting material and heated directly by the heater-lamp 32. Therefore, it may be instantaneously heated and kept at the specified temperature. Namely, this heat-resistant belt 31 is different from the conventional rotatably-driven roller in that it can be made in the form of a thin film and heated up to a specified temperature as soon as the heater-lamp 32 is turned ON. This makes it possible to sufficiently heat the heat-resistant belt 31 without increasing the heat capacity of the heater-lamp 32, resulting in saving the power consumption of the device. Furthermore, provision of the reflecting plate 33 together with the heater-lamp 32 inside the heat-resistant belt 31 realizes concentrically heating such a surface area of the rotating heat-resistant belt 31 that currently contacts with the sheet 28 carrying thereon a toner image to be fixed. In other words, the heat-resistant belt 31, unlike the conventional roller requiring heating its whole body, may be heated only a portion of the rotating belt currently necessary for fixing the toner image on the sheet. This realizes effective use of heat, making it possible to shorten the warm-up time and save the power consumption of the device.

The heat-resistant belt 31 is driven by frictional contact of the driving roller 54, that eliminates the necessity of using expensive transmission gears and bearings which are used for the conventional heating roller. Furthermore, provision of the belt guide 34 and reflecting plate 33 assures stabilized rotation of the heat-resistant belt 31, thereby the driving system can be simplified and the manufacturing cost of the device may be correspondingly reduced.

The sheet 28 can be pressed against the heat-resistant belt 31 by using the paper guide plate 50 only, that eliminates the necessity of using conventional pressing means and an expensive silicone-rubber roller. The manufacturing cost of the device may be considerably reduced in comparison with the conventional device.

Figure 5:
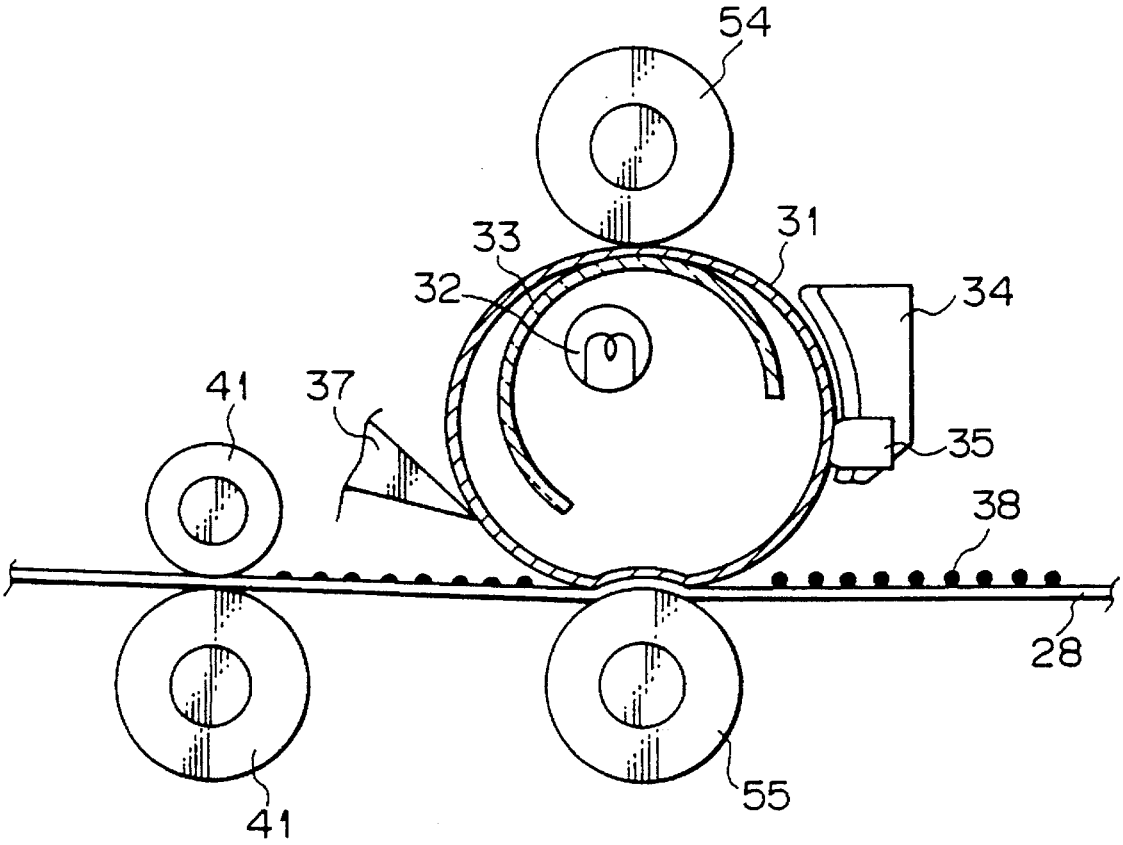
FIG. 5 is a sectional view of another example of a toner image fixing device embodying the present invention.

The toner-image fixing device 30 shown in FIG. 3 uses a flat type paper-guide plate 50 which is required to guide a sheet 28 to a contacting portion of the heat-resistant belt 31, while the conventional method requires using an expensive silicone-rubber roller which must be elastically deformable. Namely, in the device according to the present invention, the heat-resistant belt 31 can be elastically deformed in radial direction to form a sufficient contact (nip) with the sheet 28 and, therefore, it is required to provide an inexpensive rotatable roller. Referring to FIG. 5, there is shown an example of providing a paper guide roller 55 which is rotatably disposed instead of the paper guide plate 50 of FIG. 3. In the shown case, the roller 55 can rotate as the heat-resistant belt 31 rotates, thereby the sheet can be more smoothly transported. In FIGS. 3 and 5, numeral 37 designates a separating finger contacting at its tip with the outer surface of the heat-resistant belt 31 to separate the leading edge of the sheet 28 from the belt 31.

On the other hand, in case of the fixing device 30 of FIG. 3, the sheet must be transported along the paper guide plate 50 by frictional drive of the rotating heat-resistant belt 31, therefore it is important to reduce the friction coefficient of the paper guide plate 50 relative to the sheet. For this purpose, it is effective to apply a coat of fluorocarbon resin (PTFE: Polytetrafluoroethylene) on the surface of the paper guide plate 50 to be in contact with a sheet 28. The PTFE coat on the paper-guide plate is well-releasable from the toner image. Therefore, it may be free from toner adhesion thereto and may not soil the reverse side of the sheet 28 with toner. The PTFE coat of the paper-guide plate 50 lightens adhesion with the sheet 28 and makes the frictional resistance of the paper guide plate 50 relative to the sheet 28 smaller than that of the heat-resistant belt 31 relative to the sheet 28, that enables the sheet 28 to smoothly move along the paper guide plate 50 by the frictional drive of the heat-resistant belt 31 without slipping on the sheet 28. In short, the heat-resistant belt 31 can stably transport the sheet 28 and reliably fix the toner image on the sheet 28 with no disturbance of the image.

Since the heat-resistant belt 31 contacts the toner image on the sheet 28, its contact surface is desired to have enough ability to part from toner image. Namely, it is essential to prevent toner from adhering first to the heat-resistant belt and then transferring to a next sheet (toner offset). For this purpose, the heat-resistant belt is covered with a coat of fluorocarbon resin. In case the paper guide plate 50 is also coated with fluorocarbon resin, the heat-resistant belt 31 and the paper guide plate 50 have the same frictional resistance against the sheet 28, that may cause the belt 31 to rub and break the toner image on the sheet 28. In this case, it is effective to make toughened the fluorocarbon-resin coated surface of the heat-resistant belt 31 to increase its friction coefficient more than that of the paper guide plate 50. In this case, it is often conducted to reduce reflection by toughening the toner-image carrying surface of the sheet 28 to be heated. The coated surface of the paper guide plate 50 is preferred to have been smoothly finished. It is also possible to cover the surface of the heat-resistant belt 31 with a coat of silicone rubber being free from toner adhesion thereto and having such a friction coefficient relative to the sheet 28 that is sufficiently higher than that of the paper guide plate 50. By doing so, the possibility of breaking the toner image is eliminated and the transportability of the sheet is also improved.

As shown in FIG. 3, a heat insulating member 51 is disposed under the paper guide plate 50 to reduce discharge of the heat-resistant belt 31 through the paper guide plate 50. This may increase the coefficient of effective use of heat, reducing warm-up time of the fixing device. It is preferable to use the heat insulating member 51 having heat conductivity of no more than 10 W/mK, which may be, e.g., silicone-rubber foam, fluorocarbon-rubber foam, polyurethane foam and chloroprene foam. The heat insulating member 51 may be arranged under the whole length of the paper guide plate 50. It is effective to dispose the heat insulating member 51 under the area of the paper guide plate 50, which is equal to or a little more than the area of contact of the heat-resistant belt 31 with the sheet 28. In this case, the paper guide plate 50 is secured to a frame of the fixing device by means of the heat insulating member 51.

If there is still a fear of occurrence of toner offset by that toner from a currently processed sheet 28 adheres to the coated surface of the heat-resistant belt 31 and is then transferred to a next sheet 28 to be processed, it is optimal to clean the surface of the heat-resistant belt 31 before the belt S1 comes into contact with the next sheet. Cleaning can be conducted, for example, by a cleaning blade 36 which is secured at one end to the belt guide 34 and pressed at the other free end against the external surface of the heat-resistant belt 31 to scrape off toner particles adhered to the belt surface. The blade 36 may be made of, e.g., stainless steel sheet SUS304 of 0.2 mm in thickness.

Figure 6:
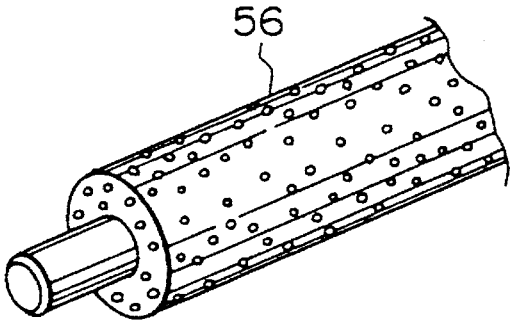
FIG. 6 is a perspective view of a cleaning roller composing a part of a toner image fixing device embodying the present invention.

It is also effective to provide a cleaning roller in place of the cleaning blade 36. FIG. 6 shows an example of a cleaning roller 56 which is made of silicone rubber and may be driven either from a driving motor (not shown) through transmission means or by frictional contact with the heat-resistant belt 31.

The above-mentioned cleaning roller 56 may be made of silicone-rubber foam impregnated with silicone oil that may exude little by little by the effect of heat and pressure from the heat-resistant belt 31 and lubricates the surface of the heat-resistant belt when the roller is cleaning the belt. Lubrication with silicone oil improves the ability of the belt 31 to part from the toner image and, thereby, effectively prevents contamination of the belt surface with toner particles.

The above-mentioned silicone-rubber roller 56 for cleaning the heat-resistant belt 31 can be also used as the driving roller 54. In short, the silicone-rubber roller of FIG. 6 is used in place of the driving roller 54 of FIG. 3.

As described above, the toner fixing device (FIG. 3) according to the present invention may be composed of, at least, a rotatable heat-resistant belt 31 made in the form of a cylinder body, a heater-lamp 32 and a paper guide plate 50 for guiding a sheet 28 to pass through a nip portion formed between the heat-resistant belt 31 and the paper guide plate 50. When the sheet 28 is nipped, the cylindrically formed heat-resistant belt 31 is elastically deformed by the paper guide plate 50 and presses the toner image carrying sheet 28 by its force to restore to the original form and, at the same time, heats the toner image thereon by its surface heated by the heater-lamp 32. The toner is fused and toner image is fixed on the sheet 28.

In the toner image fixing device, it required about 5 seconds to heat the heat-resistant belt 31 from an ambient temperature 25° C. to a specified surface temperature of 180° C. necessary for fixing the toner image on the sheet. The experiment was conducted in such conditions (material and thickness of the belt 31 and temperature of the heat-resistant belt S1 and heat capacity of the heater lamp 32), which are defined for the preferred embodiment of the present invention. The fixing device according to the present invention in comparison with the conventional device of FIG. 1 proved considerable reduction of the warm-up time. Consequently, the required power consumption of the device was reduced by 40% as compared with that of the conventional device.

As is apparent from the foregoing, the toner fixing device according to the present invention offers the following advantages:

Since a heating and fixing portion which comes into contact with a toner image on a sheet of recording paper is not a roller but an elastically deformable cylinder body having a very thin wall, it is possible to shorten the warm-up time necessary to heat the cylinder wall by a heater to a specified temperature. Using the cylindrical body made of metal having a high heat conductivity may further reduce the warm-up time of the device.

The cylinder body is driven by frictional contact with a driving roller and is elastically deformable to press a toner-image carrying sheet, that makes it possible to simplify the driving system and to use an inexpensive pressure member. By virtue of this, the device can be manufactured at considerably reduced cost in comparison with the conventional device.

We claim:

1. A toner image fixing device for fixing, by heating, a toner image developed on a sheet of recording paper, comprising a rotatable cylinder body made of heat-resistant and heat-conducting material, which has a wall elastically deformable in radial direction to form a nip having a width necessary for fixing the toner image on the recording paper;

a heater disposed in the cylinder body and a plate, partially surrounding the heater, which has a first surface, which reflects heat from the heater toward the cylinder body, and a second surface which provides support to the cylinder body; and a paper guiding member, abutting on an external cylindrical surface of the cylinder body, to elastically deform said cylinder body in radial direction to form said nip between the paper guiding member and the cylinder body and to support a reverse side of the recording paper bearing, on its upper side, the toner image.

2. A toner image fixing device as defined in claim 1, wherein the paper guiding member is a flat plate supported by a heat insulating member tending to reduce heat loss from the cylinder body through the paper guiding member.

3. A toner image fixing device as defined in claim 1, wherein the paper guiding member is a roller.

4. A toner image fixing device for fixing a toner image developed on a sheet of recording paper by heating, comprising:

a rotatable cylinder body made of heat-resistant and heat-conducting material, which has a wall elastically deformable in radial direction to form a nip of width necessary for fixing the toner image on the recording paper;

a heater disposed in the cylinder body;

a reflector plate abutting on an inner cylindrical surface of the cylinder body to reflect radiation heat from the heater;

a paper guiding member abutting on an external cylindrical surface of the cylinder body to elastically deform said cylinder body in radial direction to form a the necessary nip therebetween and to support a reverse side of the recording paper carrying the toner image developed on its top side;

a driving roller for rotating the cylinder body being sandwiched between the driving roller and the reflector plate; and a cylinder guiding member disposed between the driving roller and the paper guiding member around the cylinder body to regulate rotation of the cylinder body.

5. A toner image fixing device as defined in claim 4, characterized in that the cylinder guiding member has a sensor for sensing a surface temperature of the cylinder body to generate a temperature detection signal for controlling electric energy to the heater.

6. A toner image fixing device as defined in claim 4, characterized in that the reflector plate has a form suitable to concentrically irradiate an area wherein the recording paper contacts with the cylinder body.

7. A toner image fixing device as defined in claim 4, characterized in that the cylinder guiding member is provided with a cleaning blade being in contact with the external cylindrical surface of the cylinder body.

8. A toner image fixing device as defined in claim 4, characterized in that the driving roller is formed of material for cleaning the external cylindrical surface of the cylinder body or of material impregnated with silicone oil being well-releasable from the toner to apply the silicone oil to the external cylindrical surface of the cylinder body.

* * * * *